US006513475B2

(12) United States Patent
Muth

(10) Patent No.: US 6,513,475 B2
(45) Date of Patent: Feb. 4, 2003

(54) ROTARY VALVE INTERNAL COMBUSTION ENGINE

(76) Inventor: Barry Muth, 2721 Clifton Ave., Creedmoor, NC (US) 27522

( * ) Notice: Subject to any disclaimer, the term of this patent is extended or adjusted under 35 U.S.C. 154(b) by 0 days.

(21) Appl. No.: 09/837,017

(22) Filed: Apr. 18, 2001

(65) Prior Publication Data

US 2002/0152983 A1 Oct. 24, 2002

(51) Int. Cl.[7] ..... F01L 1/34

(52) U.S. Cl. ..... 123/190.15; 123/80 BB; 123/568.13

(58) Field of Search ..... 123/80 BB, 80 D, 123/190.5, 190.15, 190.2, 568.13

(56) References Cited

U.S. PATENT DOCUMENTS

| | | | | |
|---|---|---|---|---|
| 2,408,846 A | * | 10/1946 | Golden et al. | 123/568.12 |
| RE25,787 E | | 6/1965 | Gary | |
| 3,906,922 A | | 9/1975 | Dane, Jr. | |
| 3,945,359 A | | 3/1976 | Asaga | |
| 4,149,498 A | | 4/1979 | Ferrell | |
| 4,279,225 A | | 7/1981 | Kersten | |
| 4,370,955 A | | 2/1983 | Ruggeri | |
| 4,815,428 A | | 3/1989 | Bunk | |
| 5,000,136 A | | 3/1991 | Hansen et al. | |
| 5,154,147 A | | 10/1992 | Muroki | |
| 5,377,635 A | | 1/1995 | Glover | |
| 5,474,036 A | | 12/1995 | Hansen et al. | |
| 5,579,734 A | | 12/1996 | Muth | |
| 5,582,140 A | | 12/1996 | Strieber | |
| 5,816,203 A | | 10/1998 | Muth | |
| 6,155,215 A | | 12/2000 | Muth | |

FOREIGN PATENT DOCUMENTS

| | | |
|---|---|---|
| DE | 4324263 | 12/1993 |

* cited by examiner

*Primary Examiner*—Noah P. Kamen
(74) *Attorney, Agent, or Firm*—Coats & Bennett, P.L.L.C.

(57) ABSTRACT

An engine comprises an engine block having at least one combustion chamber and a rotary valve rotatably mounted on top of the engine block. The rotary valve includes an intake passage for diverting air into the combustion chamber and an exhaust passage for exhausting combustion by products from the combustion chamber. The engine further includes a head surrounding the rotary valve. Seals surrounding the combustion chamber seat against the bottom surface of the rotary valve. Seals on the circumference of the rotary valve seat against the head. The seals are arranged to provide a double seal for the combustion chamber during the initial portion of the power stroke. The rotary valve may further include a pressure relief valve to reduce pressure and temperature in the combustion chamber during at least a portion of the power cycle.

29 Claims, 7 Drawing Sheets

ROTARY VALVE INTERNAL COMBUSTION ENGINE

FIELD OF THE INVENTION

The present invention relates generally to internal combustion engines, and more particularly, to an internal combustion engine utilizing a rotary valve for directing the flow of intake air into the cylinders and exhausting gases from the cylinders.

BACKGROUND OF THE INVENTION

Increasing concerns about the impact of the internal combustion engine on global warming are putting added pressures on the automotive industry to develop more environmentally friendly engines. Generally, the approach is to increase the fuel economy of the engine by reducing the displacement in efforts to burn less fuel. This small displacement engine would be used as a stand alone power plant or as the principal source of power in an electric hybrid configuration. Currently, the most promising approach is to use the most efficient internal combustion engine, the direct injection diesel, and reduce its displacement to as small as operationally possible. It is in this application and as a small cylinder displacement stand alone power source that the Rotary Valve Diesel (RVD) is expected to be particularly well suited.

Previous art on the RVD attempted to reduce emissions by using the same strategy used decades ago with the Otto gasoline engine to increase fuel economy. Thus, as stated above, the displacement of the engine was decreased in an effort to burn less fuel per mile which also would result in reduced emissions. However, this small displacement engine would encounter the same problem as with the Otto engines, namely, reduced output. The RVD again used the same strategy of increasing rpms' to increase output as was done earlier with the Otto engine. Also, some modest increase in efficiency due to improved thermodynamic and volumetric efficiency would add to this output. This increased power would increase consumer acceptance of the engine and with that, both fuel consumption and emissions would decrease.

While the RVD exhibits many advantages over conventional diesels when attempting to build small cylinder displacement engines, it still does not dramatically reduce either emissions or the characteristic diesel noise associated with the—fast burn phase of combustion in comparison to conventional diesels of similar displacements. The diesel noise is potentially problematic because of consumer aversion to this condition.

The art now presented makes major improvements in the reduction of both noise and emissions as well as reductions in cost while increasing durability. A new feature, the Peak Pressure Reducing Valve (PPRV), can reduce or prevent the spike in pressure and temperature by opening a valve during the rapid burn phase of the combustion cylinder and instantly transfer this heat and pressure to the compression cylinder. First, this reduces noise and second it reduces NOx. The PPRV reduces NOx by preventing its creation and performs like an EGR system allowing for the reduction of any NOx that is produced.

The PPRV also reduces HC emissions. HC emissions are produced by incomplete burning in crevice spaces. Most of the crevice spaces in the RVD are located above the piston, around the seals, and above the top most piston ring. Being that the combustion bowl is off center and the opening for the PPRV is at the point located in the seals closest to the center of the engine, the area of greatest concentration of HC emissions is this very same area from which the combustion gas is drawn while the piston is still relative close to the valve. These gases are passed to the cylinder in the compression cycle to become part of the charge to be burned during the next combustion cycle.

Also reducing NOx is the cooled EGR system located on the rotary valve. Adding to reduced emissions is the cooling of the intake charge by the cooling fins placed on the valve housing. A second benefit of cooling the intake charge is an improvement in volumetric efficiency.

Also increasing efficiency is the PPRV. Thermal efficiency should be improved due to the mixing of gas in both the compression and combustion cycle cylinders ultimately creating more complete combustion. This mixing is due to the very rapid exit of gas from the combustion cylinder and injection into the compression cylinder creating turbulence in both cylinders. Another feature increasing efficiency is the thermal transfer plate which transfers heat via conduction from the power stoke to the compression stroke. Both the PPRV and the thermal transfer plate are positioned not to operate until the intake is fully closed. Heat energy is now added to the compression cycle by both elements. This added heat energy is then present at the beginning of the combustion cycle allowing more reliable and quicker ignition. This is especially important as cylinder displacement is reduced and would allow the RVD to operate in cylinder displacements smaller than conventional diesel engines.

Finally, the last two features increase durability. First, the valve shape is changed to a more "bell" shaped configuration and made smaller making it stronger. Lastly, the seal system is changed adding a double piston type seal around the valve. This in combination to the seals on the block allow the double sealing of the initial 60% to 65% of the power stroke.

The last point to be addressed is the use of ceramics or ceramic coatings on the RVD. While this technology can also be used on conventional engines, it should be less costly when used on the RVD. This would be due to fewer parts being affected and the parts affected being relatively easy to coat. In the RVD the same exhaust serves several cylinders and therefore has more heat available to burn soot. This effect can be increased at relatively low cost by coating the exhaust with ceramics.' An additional benefit of this coating would be less heat transferred to the intake charge. Similarly, a ceramic coating on the bottom of the valve would also reduce heat transfer and increase the durability of the valve. Coating both of these elements would be the start of making the RVD a low heat rejection engine.

All the improvements of the RVD are intended to allow a small cylinder displacement diesel to replace the Otto gasoline engines of the same power. The RVD could be used in the preferred embodiment of one rotary valve serving four cylinders or in engines having multiples of four cylinders. Potential markets would include light auto and truck, outboard marine, motorcycles, and light aircraft to name a few. However, given that the RVD appears to have significant emissions and noise advantages, it would be expected that the RVD technology would be applied to Diesels of ever increasing cylinder displacement engines. Therefore the potential market for the RVD is huge. Correspondingly, the potential for fuel savings and reduction in emissions and greenhouse gases is very significant.

SUMMARY AND OBJECTS OF THE INVENTION

The present invention is an internal combustion engine having at least one cylinder. A rotary disk valve is located over the top of the cylinders for rotation about an axis parallel to the axis of the cylinders. The center of each cylinder is equally spaced from the axis of rotation of the rotary disk valve. The valve includes an intake passage for directing intake air into the cylinders and an exhaust passage for exhausting combustion gases from the cylinders. The intake passage and exhaust passage in the rotary valve communicate with each cylinder in succession as the valve rotates, allowing the use of a single valve to serve multiple cylinders. The rotary valve uses piston type seals to prevent the movement of gas from the cylinders past the valve. This valve seal is well lubricated by an oil nozzle to produce a tight seal with minimal friction. Another set of seals is located around the major portions of the tops of each cylinder to prevent the movement of engine gases between cylinders.

In another aspect of the engine, the intake and exhaust valve openings as well as the intake and exhaust passages are increased in size by at least 40% over conventional poppet valve engines. This not only increases pumping efficiency, but also allows the air transport capacity to be increased from at least double to as much as four times that of conventional engines.

While the rotary valve engine herein described could use various fuels, the preferred fuel would be diesel. As such, the rotary valve engine as described, is referred to as the Rotary Valve Diesel (RVD) and further comparisons to conventional engines will be inferred to be poppet valve diesel Engines.

Another feature of the RVD shapes the intake and exhaust valve openings of the valve to minimize valve overlap while maximizing valve opening areas. This allows the engine to be kept very compact without compromising pumping efficiencies. Further, the openings can be shaped to allow the RVD to double seal the first 60 to 65% of the power stroke increasing the RVD's sealing capacity.

The RVD uses twin counter rotating crankshafts in engine configurations of four cylinders and larger. This four cylinder configuration or multiples of this format are the preferred embodiment of this engine. In the four cylinder, this configuration requires that each crankshaft have two crank throws which are adjacent and 180 degrees apart. Each crankshaft has gears attached to it which mesh together to synchronize the crankshafts and transfer power to the crankshaft with the flywheel attached to it. The other crankshaft has a gear on it to drive the valve. This arrangement is very effective in reducing vibration with minimal counter weighting and produces high torque.

The crank throws of each crankshaft overlap as they rotate. This is possible because the crank throws of opposing crankshafts rotate 180 degrees out of phase. The use of this feature allows the cylinders to be placed closer together, thereby making the engine more compact.

The RVD uses several elements to reduce emissions. The most dramatic element is the use of the Peak Pressure Reducing Valve (PPRV). The PPRV is located on the rotary valve and has an intake timed to open at the beginning of the fast burn phase of combustion with the intent of minimizing or preventing the rapid spike in temperature and pressure. The PPRV closes at what would be the end of this normally occurring spike. The PPRV opening transfers gas through a passage located in the rotary valve from this high pressure area to a lower pressure area, the compression cylinder. PPRV opening is sized to only allow enough gas to be transferred from the combustion stroke to the compression stroke to smooth out the pressure and temperature rise. Since the combustion temperature is reduced, NOx emissions are reduced. Also, as the gas escapes from the combustion cylinder, it should take much of the gas caught in the crevice space above the piston and transfer this gas to the compression cylinder to then be burned when this cylinder enters its' own combustion cycle. Since crevice spaces are responsible for increased HC emissions, this should reduce HC emissions. Finally, soot also is reduced due to the rapid exit of gas from the combustion cylinder and the rapid entrance into the compression cylinder causing increased turbulence in both cylinders resulting in more complete combustion in the combustion cycle. Further soot reductions could be made by coating the inside surface of the exhaust with ceramics.

Another key benefit of the PPRV is the also related to reducing the pressure and temperature spike in the combustion cycle. This is the reduction of the noise produced by this event. As this is a major consumer complaint, reducing and possibly eliminating this noise would make the RVD much more attractive to consumers.

The final benefit of the PPRV is its' ability to transfer heat energy to the compression cycle. This heat is transferred as the hot gas moves through the PPRV to the compression cylinder. More heat energy is transferred from the combustion cycle to the compression cycle by the Thermal Transfer Plate. This device is simply a plate made.

It should be noted that the EGR should also reduce HC emissions. This is due to the EGR intake picking up any trapped gas from between the cylinders as it rotates from one to the next. HC rich gas could be present in this area if the seals experience any leakage during the combustion cycle.

The last new feature, is the cooling of the valve housing. Cooling fins are added to the valve housing to cool the intake charge contained within it. Being that the surface area of the valve housing is quite large, it provides ample opportunity to cool the intake air. In addition, a conventional intercooler could also be used to further cool the intake charge.

Based on the foregoing, it is a primary object of the present invention to provide a rotary valve engine which has lower emissions than conventional poppet valve engines.

Another object of the present invention is to provide a rotary valve engine which exhibits lower noise, vibration and harshness than conventional poppet valve engines.

Still another object of the present invention is to provide a rotary valve engine which has both greater pumping efficiencies and air transport capacities as compared to conventional poppet valve engines.

Yet another object of the present invention is to provide a rotary valve engine which has greater thermal efficiencies than conventional poppet valve engines.

Another object of the present invention is to provide a rotary valve engine which is more compact and lightweight than conventional poppet valve engines.

Still another object of the present invention is to provide a rotary valve engine which will increase the rpms compared to conventional poppet valve engines.

Yet another object of the present invention is to provide a rotary valve engine which will increase the power to weight ratio as compared to conventional poppet valve engines.

Another object is to provide a rotary valve engine which is relatively inexpensive to produce.

Still another object of the present invention is to provide a rotary valve engine which is very reliable.

Other objects and advantages of the present invention will become apparent and obvious from a study of the following description and accompanying drawings which are merely illustrative of such invention.

DETAILED DESCRIPTION OF THE INVENTION

Figure 1:
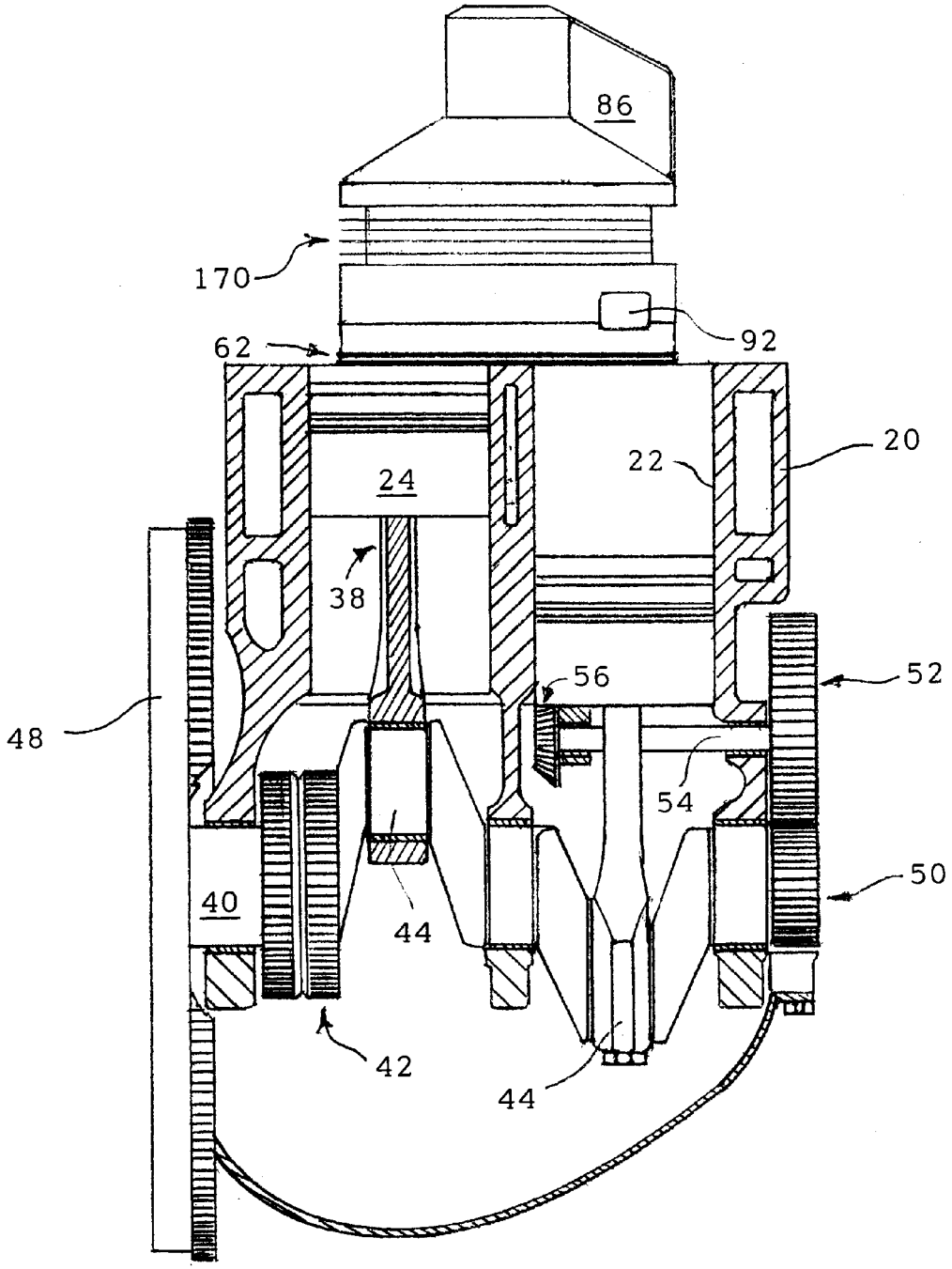
FIG. 1 is a longitudinal cross-section of the rotary valve engine block through the centers of the two closest cylinders with the rotary valve in elevation view.
Figure 2:
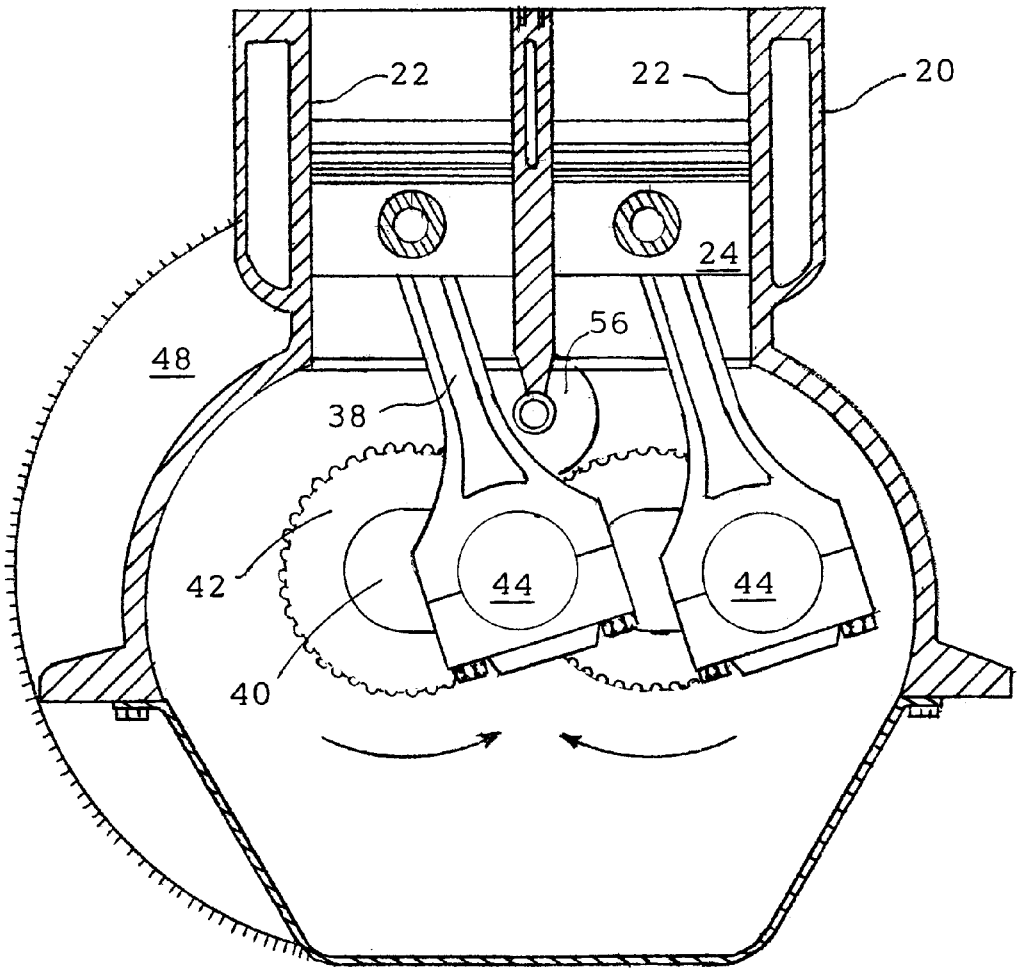
FIG. 2 is a cross-section of the rotary valve engine block viewed parallel to the crankshafts and through the centers of the two closest cylinders.

Referring now to the drawings, the rotary valve engine of the present invention is shown therein and indicated generally by the numeral 10. The rotary valve engine 10 includes an engine block 20, indicated generally at 20, having a plurality of cylinders 22 in which reciprocating pistons 24 are mounted. A rotary valve assembly 70 is disposed on the top of the engine block 20 for directing air into cylinders 22 and exhausting combustion gases. The rotary valve assembly 70 comprises a valve housing 100 supported by support assembly 115 mounted on head 102 and a single disc-type rotary valve 72.

The engine block 20 encloses cylinders 22 circumferentially spaced about the axis of rotation of the valve 72. The center of each cylinder 22 is equidistant from the rotational axis of the valve 72. A piston 24 is mounted for reciprocating movement within each cylinder 22. Each piston 24 is connected by a piston rod 38 to a rotating crankshaft 40. The disclosed embodiment has two, parallel crankshafts 40 each with antibacklash gears 42 which mesh with one another. FIG. 1 shows each gear 42 has a grove in it to allow oil to be quietly dissipated. The antibacklash gears 42 can also be separated at this grove to allow the use of two distinct gears. This would allow one gear to be staggered by a half tooth to again reduce vibration. The use of cycloidal antibacklash gears could reduce gear friction. As the antibacklash gears 42 mesh together, the two crankshafts will rotate in opposite directions. Each crankshaft 40 includes two crank throws 44 to which respective piston rods 38 are connected. The crank throws 44 on each crankshaft 40 are disposed 180 degrees apart from one another. Thus, even though the circular path of travel of the crank throws on opposite crankshafts can overlap, the crank throws avoid contact by being out-of-phase with one another. This allows the crankshafts to be placed closer together. In addition, compared to an in-line configuration, this twin crankshaft design decreases each crankshaft length by almost two thirds or the combined length by almost one third. Not only does this latter configuration produce a much more compact design, but one that is stiffer and of less mass as well. On the end of one of crankshafts 40, is placed flywheel 48. On the opposite end of the other crankshaft, is spur gear 50, which turns spur gear 52, and shaft 54 located above crankshaft 40 but midway between them. At the end of shaft 54 is bevel gear 56 which meshes with bevel gear 98 attached to shaft 99 which drives rotary valve 72 at one half the crankshaft speed. Crankshafts with adjacent crank throws 180 degrees apart are better balanced with respect to first and second degree harmonics than is the conventional in-line four cylinder crankshaft. Further, since the RVD uses counter revolving crankshafts geared to each other, any imbalances tend to be cancelled out. Additionally, since there are no reciprocating valves to produce vibrations, but a rotating valve mass which tends to counter residual vibrations from the crankshafts, the RVD should exhibit much lower levels of vibration.

The rotary valve assembly 70 is mounted on top of the engine block 20. Within valve assembly 70 is a single disc-type valve 72 which is mounted for rotation on the engine block 20. The rotary valve 72 has a flat bottom surface 74 and a bell shaped upper surface, making the valve very strong. The valve 72 includes an exhaust passage 76 and an intake passage 84. The exhaust passage 76 includes an inlet 77 on the bottom 74 of the valve 72 and an outlet 78 at the top of the valve 72 along the axis of rotation of the valve 72. The inlet 77 of the exhaust passage 76 is positioned such that it communicates with each cylinder 22 in succession as the valve 72 rotates. Compounding fins 80 extend across inlet 77 of the exhaust passage 76. The function of the compounding fins 80 will be described below.

The intake passage 84 includes an inlet 86 disposed at the end of intake passage 84 within valve 72 extending to the bottom surface 74 of valve 72 and intake outlet 88. The inlet 86 faces the direction of rotation of the valve 72 so that it functions somewhat like an air scoop as the valve 72 rotates, creating pressure that forces air down through the intake passage 84 into the cylinders 22. In a preferred embodiment, the cross-sectional area of the intake passage 84 is at least 35% of the cross-sectional area of the cylinder.

Figure 3:
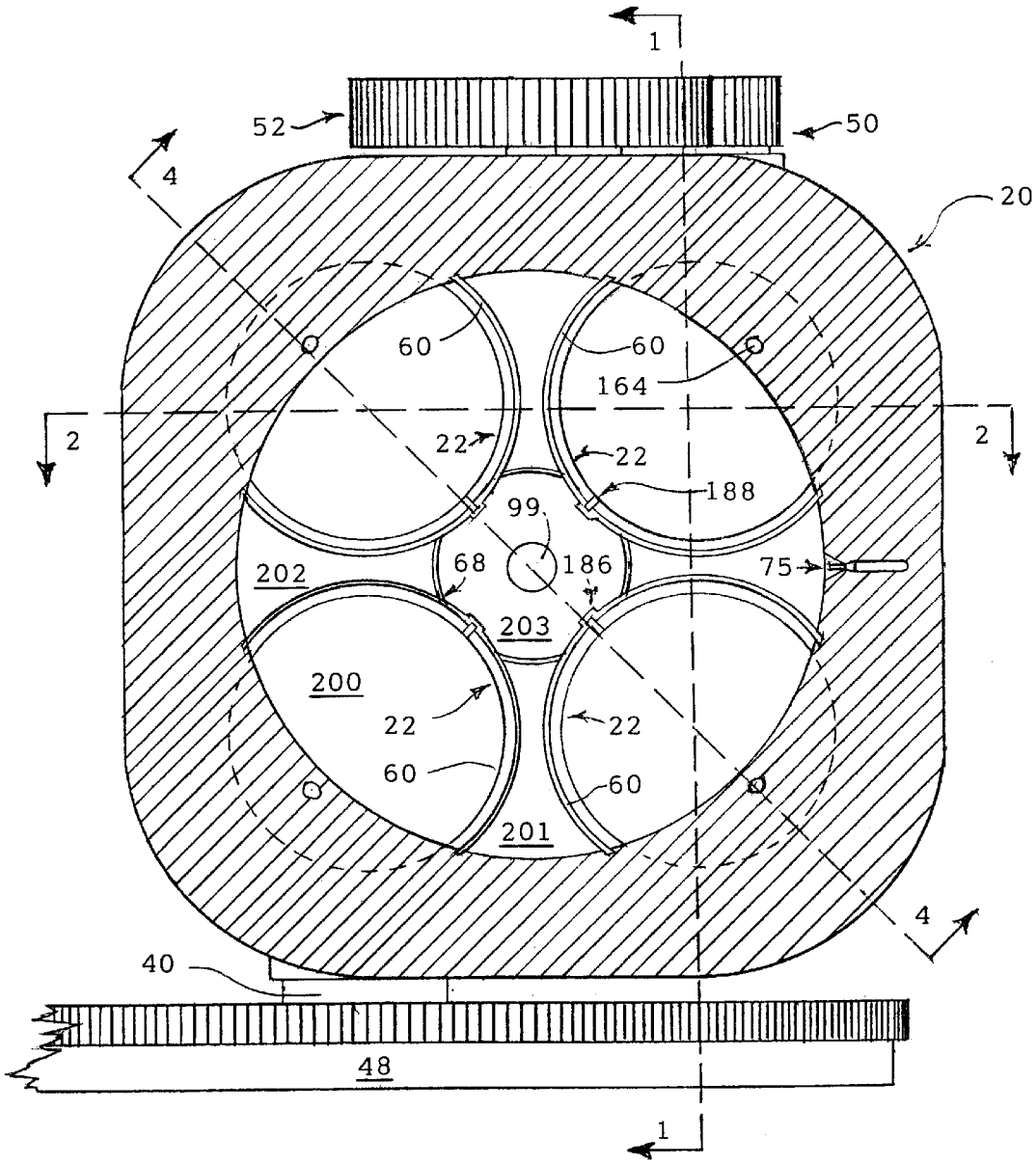
FIG. 3 is a top view of the engine block and in cross-section through the head.
Figure 4:
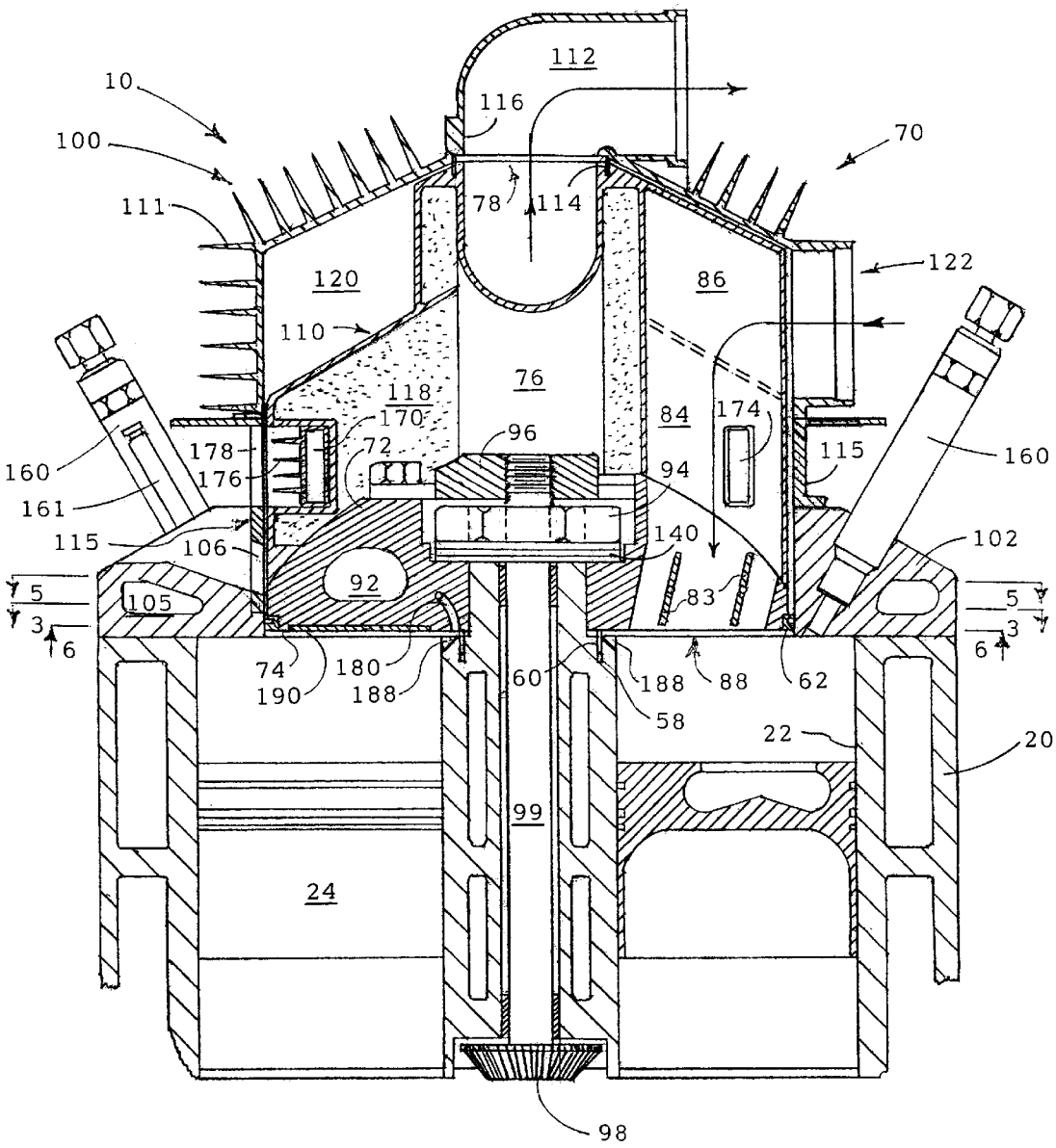
FIG. 4 is a cross-section view of the rotary valve engine diagonally through the center of the engine block taken through line 4—4 of FIG. 3.
Figure 5:
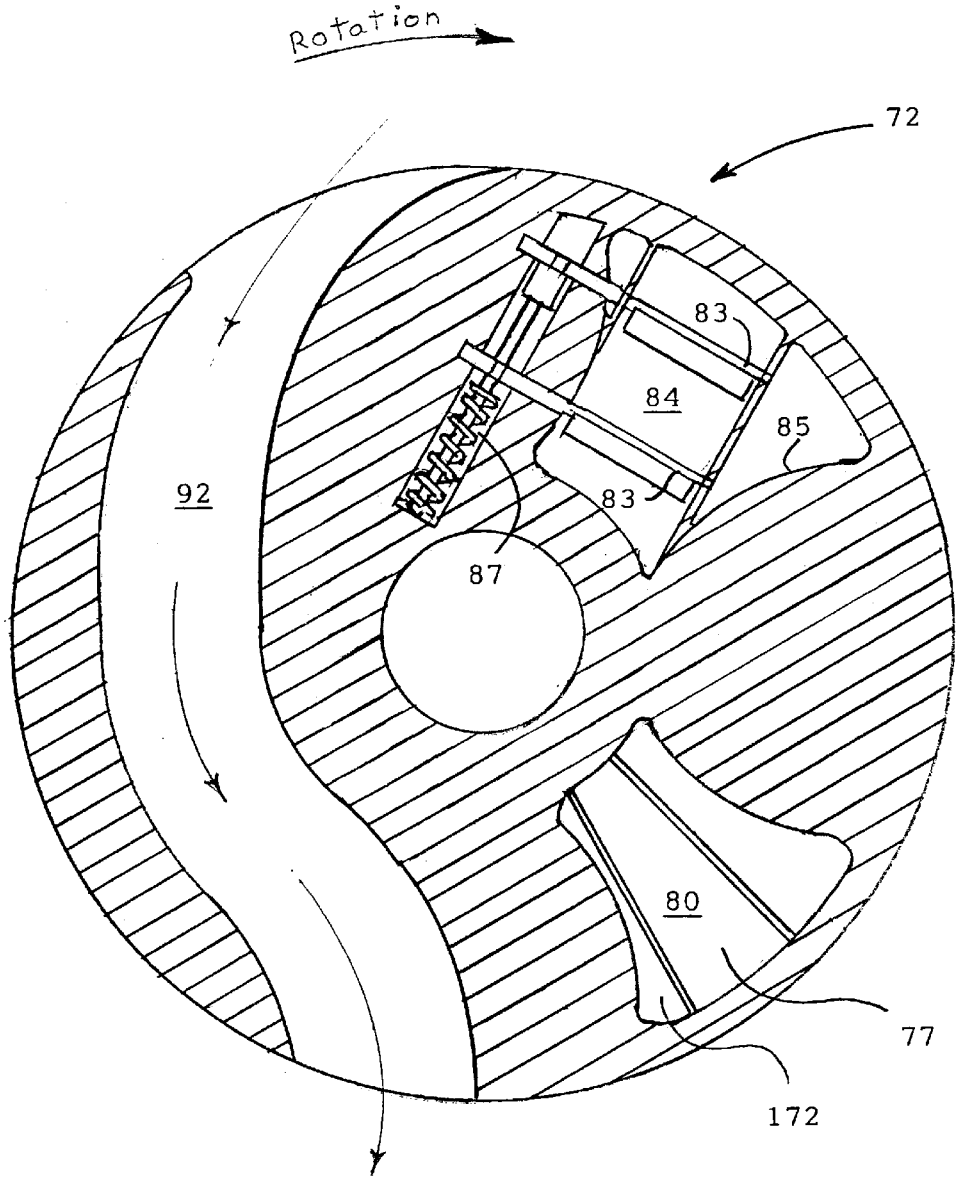
FIG. 5 is a cross-section view of the rotary valve taken through line 5—5 of FIG. 4.
Figure 6:
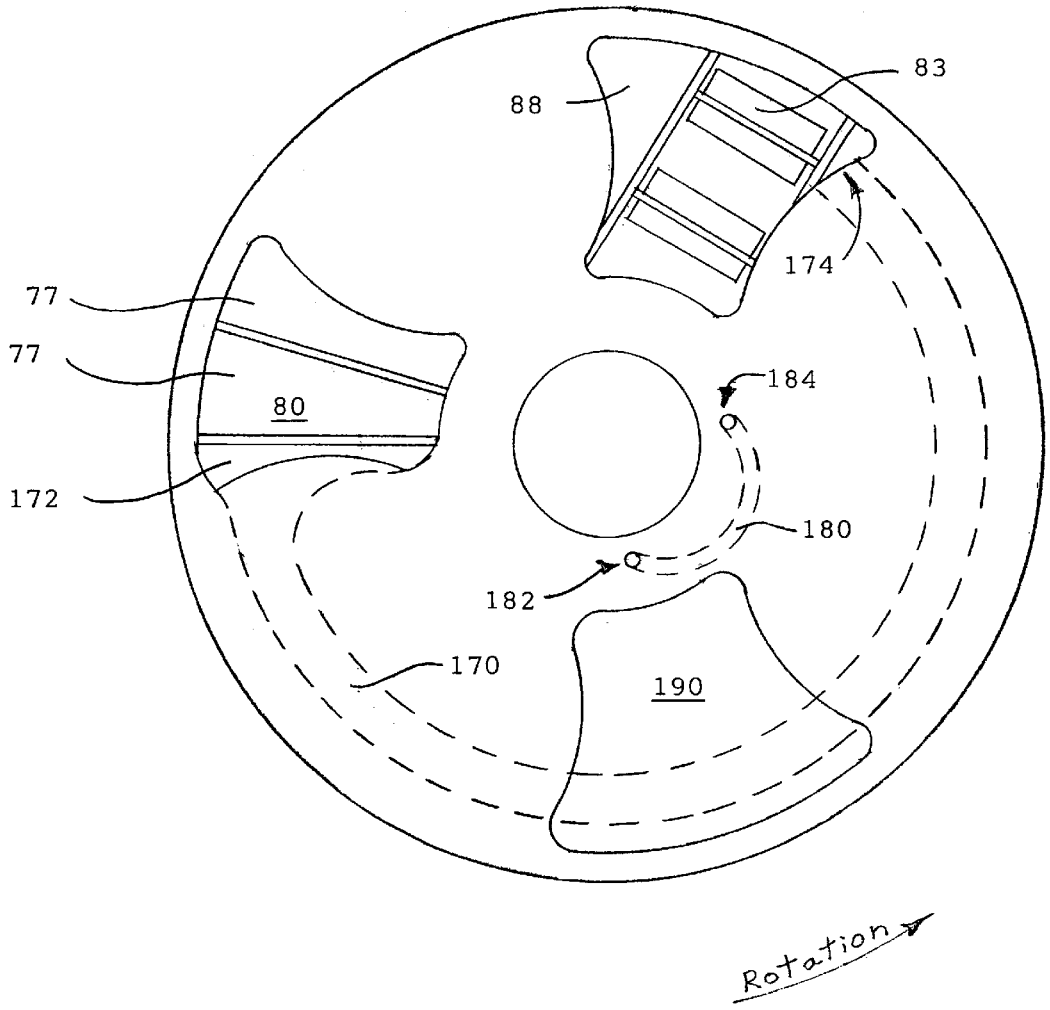
FIG. 6 is a bottom view (reversed from FIG. 5) taken through line 6—6 of FIG. 4.
Figure 7:
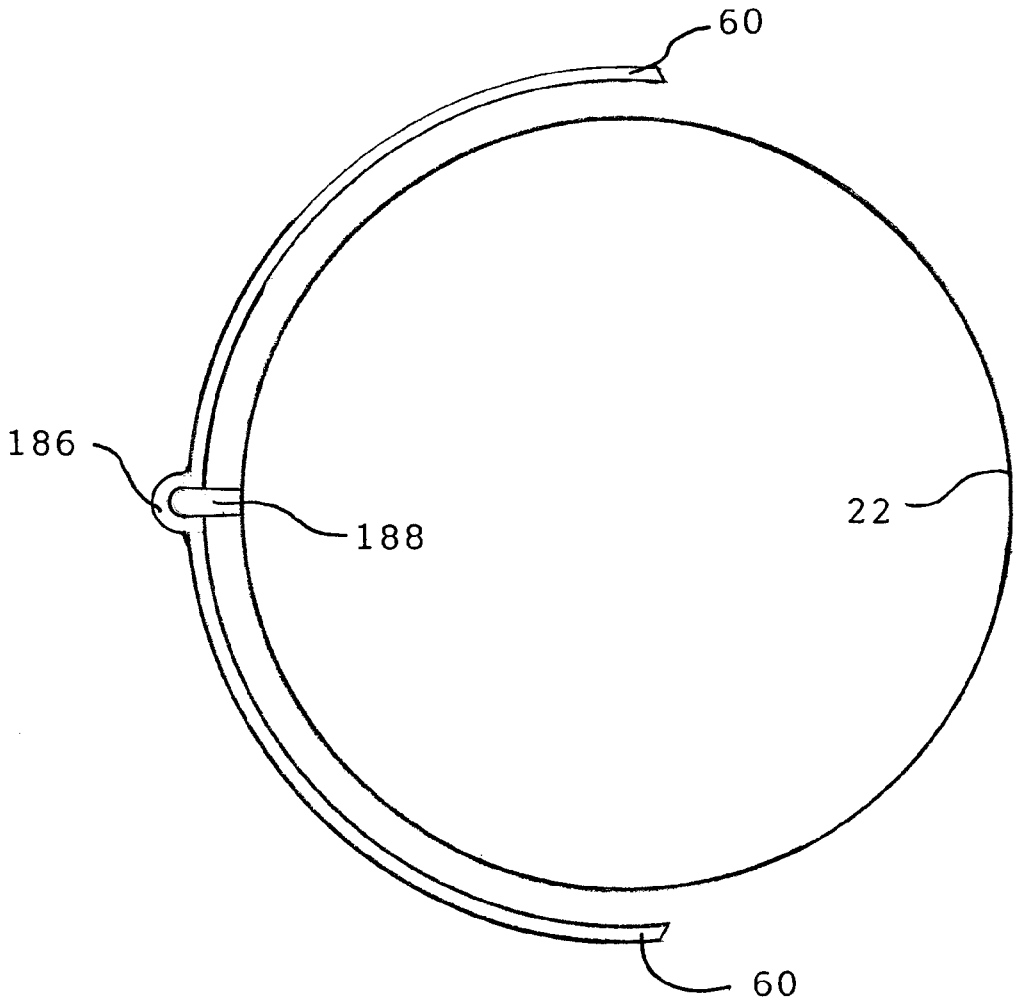
FIG. 7 is an enlarged top view of a typical cylinder demonstrating an alternate semicircular seal notch.

Of critical importance is the seal system used to control the engine gases. Most rotary valve engines are unsuccessful due to their inability to adequately seal the combustion chamber without excessive friction or excessive oil consumption. This problem is overcome by using a piston ring type seal 62 around the rotary valve. Oil nozzle 75 provides ample lubrication to the seal providing a tight seal without excessive friction. Cylinder seals 60 complete the combustion chamber seal by encircling the cylinders and recess into the head 102 while contacting the bottom edge of valve seal 62. The cylinder seals 60 fit into grooves 58 surrounding each cylinder 22. Seals 68 are mounted in a similar manner to seals 60. Seals 60 and 68 are used to prevent the movement of exhaust gas to adjacent cylinders and are lubricated by the diesel fuel. This system should be very effective in preventing the loss of gas pressure since the gas would have to move past at least two seals during the period of greatest pressure. For example, seals 68 and 60 of adjacent cylinders would prevent the passage of gasses generated by the power stroke of the cylinder in between for the first 65% of the power stroke. Referring to FIG. 3, if the cylinder experiencing the power stroke is represented by area 200, then the seals surrounding areas 201, 202, and 203 provide an additional barrier for the first 65% of the power stroke. Therefore, it would be possible to further increase the mean effective pressures generating greater output by designing the engine to allow the pressures to exceed the capacity of the single sealing capacity of seals 60 and 68, but to be constrained by the second set of seals. The amount of heat energy lost would depend upon the pressure differentials and, the volume of the spaces. The space between the valve and engine block would be limited to the amount needed for thermal expansion of the valve and block and be relative small. Additionally, the pressure in area 203 would quickly equalize to the escaping gas pressure so that little additional pressure would be lost to this area. The pressure that had escaped to area 202 is mostly constrained until after another cycle, when area 202 becomes area 201. The increased pressure already present in area 201 minimizes the, pressure loss from the new power stroke to this area. Any pressure present in area 201 is finally released as the EGR intake 172 passes above. Oil combustion as a function of output should be less in the RVD as compared to conventional diesels. This is due to the increased rpm levels allowing a smaller displacement engine to produce the same output levels as a larger displacement, but lower rpm engine. As long as the RVD is used in applications in which light load conditions are prevalent and the RVD power output is sufficient at the same rpm rates of the larger conventional engine, then the smaller cylinder surface area of the RVD would have less cylinder oil surface from which to burn oil. While the RVD does have the additional lubricated rotary valve seals to contend with, these surfaces are always covered. For the most part, only excessive oil deposition would increase oil combustion from this source. If necessary, more than one oil nozzle could be used or possibly diesel fuel could be used as the lubricant.

Valve 72 is enclosed by valve housing 100. Valve housing 100 is cooled by cooling fins 111. Also enclosed by valve housing 100 is manifold 110. The head 102 incorporates liquid cooling passages 105 and air cooling passages 106 to control thermal gradients while supporting the upper portions of the engine. Bearing 140 restrains the valve 72 while allowing the valve 72 to rotate freely. Support assembly 115 encloses valve 72 and supports valve housing 100. Air vents 106 are circumferentially spaced around valve support assembly 115. Air is drawn through vents 106 by the rotating valve 72. Air passes through a cooling passage 92 in the valve 72 cooling the interior of the valve 72. Preferably valve 72 would be insulated by ceramics on the bottom surface 74, to both reduce heat transfer to the valve and increase wear resistance of the bottom valve surface. EGR vents 178 located above vents 106 in the support assembly 115 are also circumferentially spaced to allow the cooling of EGR 170. Insulation 118, is placed at various places in the manifold 110 to reduce heat transfer between the intake and exhaust gases. A seal 114 fits in a groove on top of manifold 110 to prevent the escape of exhaust gases.

Valve housing 100 is mounted on top of support assembly 115. Valve housing 100 includes an exhaust pipe 112, preventing the escape of exhaust gases. Valve housing 100 also includes annular cavity 120 used to supply air to intake 84. Intake opening 122 receives air from the supercharger (not shown) and transports the air into the annular cavity 120. Fuel injectors 160 are mounted in head 102. Glow plug 162 is used to aid in starting rotary valve engine 10.

Also included in the rotary valve 72 are several emissions reducing devices. Peak Pressure Reducing Valve (PPRV) 180 has an intake 182 on the bottom of valve 72 leading to a passage 180 through the valve 72 to PPRV exhaust opening 184 also located on the bottom of valve 72. Both the PPRV intake 182 and PPRV exhaust 184 are actuated by passing over seal notch 186. Seal notch 186 is a small segment located in seal 60. Cylinder notch 188 provides additional clearance for the movement of the gas from cylinder to cylinder and also directs the entrance and exit of the gas to provide turbulence in both the combustion and compression cylinders.

Another emissions reduction feature located on valve 72 is EGR 170. EGR intake 172 is located on the bottom of valve 72 adjacent to exhaust inlet 77. Due to the rotation of valve 72, EGR valve 172 initiates the exhaust cycle allowing a portion of the exhaust to pass through EGR passage 170. EGR intake 172 separates from the rest of the exhaust structure to direct exhaust through EGR 170 which is cooled by EGR cooling fins 176. Cooling fins 176 are exposed to ambient air by the flow of air through EGR vents 178. The gas traveling through EGR 170 is expelled through EGR exhaust 174 into the intake passage 84.

The last feature located on valve 72 is thermal transfer plate 190. Thermal transfer plate 190 is located on the bottom surface of valve 72. The area of the thermal transfer plate 190 is determined by the area on the bottom of the valve 72 exposed to the combustion cycle extending to the compression cycle when the exhaust and intake valves are closed. Heat is transferred from the combustion cycle through the heat transfer plate 190 via conduction to the compression cycle. This heat is now present early in the next cycle, the combustion cycle, to more quickly initiate combustion of the fuel.

In operation, intake air enters the annular chamber of the valve housing 100 from the supercharger or other intake source. As the valve 72 rotates, intake air is cooled by valve housing 100 before it enters the inlet 86 continuing through intake passage 84, and enters one of the cylinders 22 of the engine block while the piston 24 is moving downward. The downward motion of the piston 24 within cylinder 22 decreases the cylinder pressure within the cylinder 22 so that together with the pressure created by turbocharging, intake air enters the cylinder 22. Pressure within intake 84 is increased by the air scoop effect and the decelerating air column caused by the closing of intake outlet opening 88. This increased pressure allows the outlet opening 88 to close after piston 24 starts upward, creating higher charge pressures in cylinder 22. Further, this effect is maintained as rpm's increase, since pressure from the scoop effect increases with increasing rpm's offsetting increasing drag created by increasing air velocities. The intake charge passes through variable valves 83 before entering the cylinder 22. Variable valves 83 are regulated by a spring and weight assembly 87. Assembly 87 uses the centripetal force of the valve to put increasing pressure against the spring to move the variable valves 83 as the velocity of the valve increases, thereby further opening the intake allowing higher volumes of air to enter cylinder 22. The bottom 74 of the valve 72 rotates over the cylinder 22 to effectively close the valve 72. The compression stroke begins with the piston 24 moving upward within cylinder 22 with the flat bottom surface of the thermal transfer plate 190 of the valve 72 overlying the cylinder 22. The upward motion of the piston 24 compresses the air within the cylinder 22. Just after intake valve 88 closes, thermal transfer plate 190 adds more heat energy to the charge. Still early in the compression cycle, the PPRV 180 forcefully injects combusted gas into cylinder 22. As this injected gas enters cylinder 22, it is directed by cylinder notch 188 adding both heat and turbulence to the gas being compressed by piston 24.

As the piston 24 reaches top dead center, fuel is injected to initiate the combustion sequence within the cylinder 22. The heat of combustion causes forceful expansion of gas that push the piston 24 downward. The downward force is carried through the piston rods 38 to the crankshaft 40 which is given a powerful turn. Just as the fast burn phase of combustion begins, PPRV intake 182 passes over the seal notch 186 allowing a portion of the gas to escape cylinder 22. This prevents the rapid pressure and thermal spike normally associated with this phase of diesel combustion. As the piston 24 continues and reaches the bottom of its power stroke, the EGR intake 172 rotates over cylinder 22. Piston 24 moves upward to expel the exhaust gas. A portion of the combusted gas is expelled through the EGR 170. Positioned immediately after EGR intake 172, exhaust inlet 77 follows allowing the remaining gas pressure to exert force on angled compounding fins 80 providing rotational energy to rotary valve 72. The exhaust gases then pass through exhaust passage 76. A seal 114 fits in a groove in the flanged end 116 of the exhaust pipe to prevent escape of exhaust gases. Since the valve serves all four cylinders, the exhaust passage 76 remains at higher operating temperatures than does conventional exhaust passages creating increased exhaust temperatures, thus decreasing emissions.

As compared to conventional Diesel poppet valve engines, the rotary valve diesel has many advantages. From a consumer acceptance viewpoint, the main advantage would be the reduction in noise, vibration and harshness. The noise reduction is mainly accomplished by the ability of the rotary valve diesel to reduce or eliminate the thermal and pressure spike produced by the fast burn phase of combustion. Most of the vibration is reduced by the stiff block configuration and the balanced counter rotating twin crankshafts.

Another very significant advantage of the rotary valve diesel is its' ability to reduce emissions levels as compared to conventional diesel poppet valve engines. NOx should be significantly reduced by the peak pressure reduction valve as it prevents the high temperatures produced by the fast burn phase of combustion. Residual NOx would be reduced by the cooled EGR. HC should also be reduced by both of these elements due to the unique way they operate in the rotary valve diesel. Soot is reduced by the cooled intake, the increased turbulence in the compression and combustion cycles and by the elevated exhaust temperatures especially if ceramic coatings are used. Finally, C02 is reduced because the rotary valve diesel burns less fuel on a per mile basis.

This illustrates the next advantage of greater fuel economy than conventional diesel poppet valve engines. The greatest fuel savings is brought about by the rotary valve diesel being capable of increasing the power density of the engine. While a modest efficiency gain is possible to reduce fuel consumption, the power density of the rotary valve diesel can be increased by increasing the rpm levels of the engine. Total power output would remain constant, but the engine displacement would be decreased. This strategy only works in cases where maximum power is required for only a relatively small portion of time during operation of the engine. Of course this strategy was employed decades ago when the Otto gasoline engine experienced its' greatest gains in fuel economy in automobiles. RPMs in the rotary valve diesel can be increased because the temperature of the compression cycle and early combustion cycle are increased; there is more charge mixing in the compression and combustion cycles; and because the rotary valve diesel can pump much more air through the engine than conventional poppet valve diesels.

The ability of the rotary valve diesel to pump much more air than conventional poppet valve diesel engines is another major advantage. The rotary valve diesel as shown can pump almost three times the air when compared to the best conventional popped valve engines. This increases pumping efficiency and aids in the rotary valve diesels' ability to increase rpms. The increased pumping and transport capabilities are due to much larger intake and exhaust openings, and much larger intake and exhaust passages.

Increased rpms are the main component to the next advantage demonstrated by the rotary valve diesel of increased power to weight ratio. Other elements contributing to the increased power to weight ratio are the compact and lightweight construction of the rotary valve diesel. The rotary valve diesel is made compact and lightweight by using twin counter rotating crankshafts with overlapping crank throws in four cylinder versions. This produces a block configuration which is not only compact, but very rigid.

The next advantage of the rotary valve diesel as compared to conventional poppet valve diesels is a modest improvement in engine efficiency. While the rotary valve diesel is not expected to have an advantage in friction, it is expected to exhibit both greater pumping and thermal efficiencies. The pumping efficiency was explained earlier and the thermal efficiency is due to better mixing of the charge in the intake, compression and combustion cycles; the use of the peak pressure reduction valve; and thermal transfer plate to transfer heat to aid in the fuel ignition; the RVD transfers less heat to the intake cycle; and using compounding fins utilizes more thermal energy.

Another very important advantage of the rotary valve diesel as compared to conventional poppet valve diesels is the ability of the rotary valve diesel to reliably operate in small cylinder displacements. In fact, it is expected that this advantage increases with decreasing cylinder displacements.

The next advantage of reliability, is in comparison with previous versions of the rotary valve diesel and other rotary valve engines. The most significant factor is the ability of the rotary valve diesel to double seal the first 60–65% of the combustion cycle while being able to adequately lubricate the seals without excessive oil consumption. Adding to the reliability is the rigid construction of the block, and the more compact bell shaped rotary valve.

The last advantage is again compared to conventional poppet valve diesels. The rotary valve diesel should be less costly to manufacture. This is mostly due to the fewer number of required parts and the simplicity of assembly. Additional cost advantages will occur as the use of ceramics increases in diesels in pursuit of low heat rejection engine technology.

Based on the foregoing it is apparent the rotary valve engine of the present invention has numerous advantages over conventional poppet valve engines. First, it produces less noise vibration and harshness. Second it has reduced NOx, HC, soot, and C02 emissions. Third, it is more fuel efficient. Fourth it has greater engine efficiency. Fifth, it is more compact and lightweight. Sixth, it has a greater power to weight ratio. Seventh, it can operate in smaller cylinder displacements. Lastly, it is less costly to manufacture.

The present invention may of course, be carried out in other specific ways than those herein set forth without parting from the spirit and essential characteristics of the invention. The presented embodiments are, therefore, to be considered in all respects as illustrative and not restrictive, and all changes coming within the meaning and equivalency range of the appended claims are intended to be embraced therein.

What is claimed is:

1. A rotary valve engine with a four stroke cycle, said rotary valve engine comprising:

(a) an engine block having at least one combustion chamber;

(b) a drive member mounted in said combustion chamber;

(c) a crankshaft rotatably mounted to said engine block and driven by said drive member;

(d) a disc-type rotary valve mounted on said engine block;

(e) an intake passage formed in said rotary valve for directing air into said combustion chamber as said rotary valve rotates;

(f) an exhaust passage formed in said rotary valve for exhausting combustion gases from said combustion chamber as said rotary valve rotates;

(g) a head mounted to said engine block and surrounding said rotary valve to enclose at least a portion of said combustion chamber; and (h) seals extending around said combustion chamber and seating against the bottom surface of said rotary valve;

(i) at least one rotary valve seal around the circumference of said rotary valve seating against said head.

2. The rotary valve engine of claim 1 wherein said seals extending around said combustion chambers create a double seal between adjacent combustion chambers for at least a portion of said power cycle.

3. The rotary valve engine of claim 1 wherein said seals create a double seal between adjacent combustion chambers for at least the initial 50% of said power cycle.

4. The rotary valve engine of claim 1 wherein said intake passage has a cross-sectional area of at least 35% of the cross-sectional area of said combustion chamber.

5. The rotary valve engine of claim 1 wherein said drive member is a reciprocating piston.

6. The rotary valve engine of claim 1 having a means to regulate the volume of air through said intake passage whereas said regulating means is a variable valve.

7. The rotary valve engine of claim 1 further comprising a compounding element disposed in the exhaust passage of said rotary valve for recapturing energy from said combustion chamber whereas said compounding element comprises a fin which is angularly disposed with respect to the flow of combustion gases through said exhaust passage.

8. The rotary valve engine of claim 1 further comprising an air scoop located on said rotating valve to pressurize air.

9. The rotary valve engine of claim 1 having said drive member connected to a crankshaft by connecting rods.

10. The rotary valve engine of claim 9 having more than one said crankshaft.

11. The rotary valve engine of claim 10 wherein said crankshafts have crank throws describing overlapping paths with each other.

12. The rotary valve engine of claim 1 having the leading edge of said intake opening having the same geometric shape of said seals.

13. The rotary valve engine of claim 1 having the leading edge of said exhaust opening having the same geometric shape as said seals.

14. The rotary valve engine of claim 1 wherein said rotary valve includes a cooling passage extending through the body of said valve such that cooling air passes through the valve body when said valve rotates.

15. A rotary valve engine, said rotary valve engine comprising:

(a) an engine block having at least one combustion chamber;

(b) a drive member mounted in said combustion chamber;

(c) a crankshaft rotatably mounted to said engine block and driven by said drive member;

(d) a disc-type rotary valve mounted on said engine block;

(e) an intake passage formed in said rotary valve for directing air into said combustion chamber as said rotary valve rotates;

(f) an exhaust passage formed in said rotary valve for exhausting combustion gases from said combustion chamber as said rotary valve rotates;

(g) a pressure reducing valve in said combustion chamber open during a portion of said combustion phase of said engine to reduce the pressure and temperature in said combustion chamber during said combustion phase.

16. The rotary valve engine of claim 15 wherein said combustion phase includes a fast burn phase, and wherein said pressure reducing valve is open during said fast burn phase.

17. The rotary valve engine of claim 15 wherein said engine is a diesel engine.

18. The rotary valve engine of claim 15 wherein said drive member is a reciprocating piston.

19. The rotary valve engine of claim 15 wherein said pressure reducing valve comprises a pressure reducing passage in said rotary valve communicating between first and second combustion chambers during the combustion phase of said first combustion chamber.

20. A rotary valve engine comprising:

(a) an engine block having a combustion chamber;

(b) a drive member mounted in said combustion chamber;

(c) a crankshaft rotatably mounted to said engine block and driven by said drive member;

(d) a disc-type rotary valve mounted on said engine block;

(e) an intake passage formed in said rotary valve for directing air into said combustion chamber as said rotary valve rotates;

(f) an exhaust passage formed in said rotary valve for exhausting combustion gases from said combustion chamber as said rotary valve rotates; and (g) an exhaust gas recirculation passage in said rotary valve to recirculate exhaust gasses between adjacent cylinders.

21. The rotary valve engine of claim 20 further including cooling means to cool said exhaust gas recirculation valve.

22. The rotary valve engine of claim 21 wherein said cooling means are fins extending from said exhaust gas recirculation valve.

23. The rotary valve engine of claim 20 wherein said drive member is a reciprocating piston.

24. A rotary valve engine comprising:

(a) an engine block having a combustion chamber;

(b) a drive member mounted in said combustion chamber;

(c) a crankshaft rotatably mounted to said engine block and driven by said drive member;

(d) a disc-type rotary valve mounted on said engine block;

(e) an intake passage formed in said rotary valve for directing air into said combustion chamber as said rotary valve rotates;

(f) an exhaust passage formed in said rotary valve for exhausting combustion gases from said combustion chamber as said rotary valve rotates;

(g) a valve housing surrounding said rotary valve, said valve housing defining an annular intake chamber; and (h) one or more cooling fins mounted on said valve housing to cool said annular intake chamber.

25. The rotary valve engine of claim 24 wherein said drive member is a reciprocating piston.

26. A rotary valve engine comprising:

(a) an engine block having at least one combustion chamber;

(b) a drive member mounted in said combustion chamber;

(c) a crankshaft rotatably mounted to said engine block and driven by said drive member;

(d) a disc-type rotary valve mounted on said engine block;

(e) an intake passage formed in said rotary valve for directing air into said combustion chamber as said rotary valve rotates;

(f) an exhaust passage formed in said rotary valve for exhausting combustion gases from said combustion chamber as said rotary valve rotates; and (g) a heat conductive plate mounted to the bottom of said rotary valve and heated by combustion during a combustion phase in a first combustion chamber, wherein said heat conductive plate transfers heat to a selected combustion chamber during a compression phase of said selected combustion chamber.

27. The rotary valve engine of claim 26 wherein said drive member is a reciprocating piston.

28. The rotary valve engine of claim 26 wherein said selected combustion chamber is different from said first combustion chamber.

29. A rotary valve engine comprising:

(a) an engine block having a plurality of cylinders;

(b) a reciprocating piston mounted in each cylinder;

(c) at least two crankshafts rotatably mounted to said engine block;

(d) a connecting rod connecting each said piston to one of said crankshafts to rotate said crankshaft as the pistons reciprocate in said cylinders;

(e) a disc-type rotary valve mounted on said engine block above said cylinders and having an axis of rotation extending generally perpendicular to the axis of rotation of said crankshafts;

(f) an intake passage formed in said rotary valve for directing air into each said cylinder in succession as said rotary valve rotates;

(g) an exhaust passage formed in said rotary valve for exhausting combustion gases from said cylinders as said rotary valve rotates; and (h) a head to enclose a portion of said cylinders.

* * * * *